US009661887B2

(12) United States Patent
Kanazawa

(10) Patent No.: US 9,661,887 B2
(45) Date of Patent: May 30, 2017

(54) BUTTON MOUNTING APPARATUS AND BUTTON MOUNTING METHOD

(75) Inventor: Hiroaki Kanazawa, Tokyo (JP)

(73) Assignee: YKK Corporation (JP)

( * ) Notice: Subject to any disclaimer, the term of this patent is extended or adjusted under 35 U.S.C. 154(b) by 472 days.

(21) Appl. No.: 14/370,226

(22) PCT Filed: Jan. 6, 2012

(86) PCT No.: PCT/JP2012/050195

§ 371 (c)(1),
(2), (4) Date: Oct. 21, 2014

(87) PCT Pub. No.: WO2013/103017

PCT Pub. Date: Jul. 11, 2013

(65) Prior Publication Data

US 2015/0052666 A1 Feb. 26, 2015

(51) Int. Cl.

| | |
|---|---|
| ***A41H 37/04*** | (2006.01) |
| ***A41H 37/00*** | (2006.01) |
| ***A41H 37/10*** | (2006.01) |
| ***A44B 1/44*** | (2006.01) |

(52) U.S. Cl.

CPC ..... *A41H 37/04* (2013.01); *A41H 37/001* (2013.01); *A41H 37/10* (2013.01); *A44B 1/44* (2013.01); *Y10T 24/3691* (2015.01)

(58) Field of Classification Search

CPC ..... A41H 37/04; A41H 37/001; A41H 37/10; A44B 1/44; Y10T 24/3691

See application file for complete search history.

(56) References Cited

FOREIGN PATENT DOCUMENTS

| | | |
|---|---|---|
| JP | S52-129508 U | 10/1977 |
| JP | 9-209209 A | 8/1997 |
| JP | 2003-019375 A | 1/2003 |
| JP | 2009-183444 A | 8/2009 |

OTHER PUBLICATIONS

International Search Report, PCT Application No. PCT/JP2012/050195, mailed Mar. 27, 2012.

International Preliminary Report on Patentability, PCT Application No. PCT/JP2012/050195, mailed Jul. 17, 2014.

*Primary Examiner* — Mark Rosenbaum

(74) *Attorney, Agent, or Firm* — Kilpatrick Townsend & Stockton LLP

(57) ABSTRACT

A button mounting device includes: a button mounting unit that comprises a first die holding the button main body and a second die holding the button mounting tool; an intermediate material formation unit that forms an intermediate material, which is to be interposed between the button main body and the cloth or between the button mounting tool and the cloth, by cutting a strip-shaped sheet material; and an intermediate material transfer unit that transfers the intermediate material formed by the intermediate material formation unit to the button mounting unit to supply the first die or the second die.

10 Claims, 19 Drawing Sheets

BUTTON MOUNTING APPARATUS AND BUTTON MOUNTING METHOD

This application is a national stage application of PCT/JP2012/050195, which is incorporated herein by reference.

BACKGROUND OF THE INVENTION

The present invention relates to a button mounting apparatus and a button mounting method, and more particularly, to a button mounting apparatus and a button mounting method capable of mounting a button main body onto a cloth while interposing an intermediate material between the button main body and the cloth or between a button mounting member and the cloth when mounting the button main body onto the cloth such as a garment with the button mounting member.

When a button main body is mounted onto a cloth, in general, after the button main body is held on an upper die and a button mounting member is placed on a lower die, the upper die is lowered toward the lower die. After a post of the button mounting member penetrates the cloth upward and then passes through a mounting opening of the button main body, the post is swaged by a punch of the upper die. Thereby, the button main body is fixed to the cloth. The cloth on which the button main body is mounted is compressed between the button main body and the button mounting member. However, when the cloth is thin, there would be a probability that mounting failure occurs such that the mounted button main body can be displaced or easily fall out. In such a case, conventionally, an intermediate material, also referred to as a packing or the like is interposed between the button main body and the cloth or between the button mounting member and the cloth in order to compensate for an insufficient thickness of the cloth. Furthermore, JP,H09-209209,A discloses a technique of interposing an intermediate material (a decorative member) having an outer diameter greater than that of the button main body in order to enhance design characteristics of a garment or the like, regardless of the thickness of cloth.

[Patent document 1] JP,H09-209209,A

However, in a case where the intermediate material is interposed as the button main body is mounted onto the cloth, under the present situation, a worker manually holds the intermediate material on the upper die or the lower die. For that reason, there is a problem that a mounting operation of button main bodies is inefficient.

SUMMARY OF THE INVENTION

Accordingly, an object of the invention is to provide a button mounting apparatus and a button mounting method capable of automatically supplying an intermediate material at the time of an operation of mounting a button main body onto a cloth with a button mounting member and capable of increasing the efficiency of the operation of mounting the button main body together with the intermediate material onto the cloth.

In order to solve the above-mentioned problems, according to the invention, there is provided a button mounting apparatus for mounting a button main body to a cloth with a button mounting member, the button mounting apparatus comprising: a button mounting unit that includes a first die configured to hold the button main body and a second die configured to hold the button mounting member; an intermediate material formation unit that forms an intermediate material from a strip-like sheet material, the intermediate material being interposed between the button main body and the cloth or between the button mounting member and the cloth; and an intermediate material transport unit that transports the intermediate material formed by the intermediate material formation unit to the button mounting unit to supply the intermediate material to the first die or the second die.

In the invention, the intermediate material cut from the sheet material in the intermediate material formation unit is automatically transported and supplied to the first die holding (or just before holding) the button main body or the second die holding (or just before holding) the button mounting member in the button mounting unit by the intermediate material transport unit. Then, by relatively moving the first die toward the second die, it is possible to mount the button main body onto the cloth while interposing the intermediate material between the button main body and the cloth or between the button mounting member and the cloth. The supply of the button main body and the button mounting member to the first die and the second die, respectively, can be performed manually by a worker or automatically performed by automatic supply devices, and in either case, it is possible to automatically supply the intermediate material formed by the intermediate material formation unit to the first die or the second die of the button mounting unit by the intermediate material transport unit.

As the sheet material, that is, the intermediate material, a textile, a fabric, a non-woven fabric, felt, leather, a resin sheet and the like are included. Furthermore, as the material of the sheet material, or the intermediate material, a thermosetting resin, a thermoplastic resin or the like can be preferably used, but is not limited thereto. A shape of the intermediate material is generally circular, but not limited thereto. For example, an oval shape, a polygonal shape, a star shape or the like may be used. A size of the intermediate material may be smaller or greater than a size of the button main body or the button mounting member. The cloth includes fabrics forming a garment, a bag or the like, a fabric, a non-woven fabric, felt, leather, a resin sheet and the like. The button main body includes snap buttons made of resin or metal, decorative buttons, eyelets and the like, but is not limited thereto. The button mounting member is a component made of resin or metal having a plate-shape base, and one post or two or more pins or the like projecting from the base. After the post or the pins penetrate the cloth, the post or the pins are swaged on the button main body side. The manner of holding the button main body and the button mounting member on the first die and the second die include placing the button main body or the button mounting member on the first die or the second die.

The intermediate material formation unit can continuously cut off the intermediate materials from the strip-like or tape-like sheet material by a cutting blade (cutter). The intermediate material formation unit also can provide the sheet material from a state of being wound in a roll shape. Further, the intermediate material transport unit can receive the intermediate material from the intermediate material formation unit, move the intermediate material to the button mounting unit, and deliver the intermediate material to the first die or the second die. As an example of delivering the intermediate material to the first die or the second die, it is possible to provide, in the first die or the second die, an intermediate material holder to which the intermediate material can be fitted and to temporarily hold the intermediate material to the intermediate material holder. As another example, it is also possible to apply an adhesive on one surface of the sheet material in advance and to temporarily attach and hold the intermediate material to the first die or the second die. Otherwise, it is also possible to temporarily attach and hold the intermediate material to the button main body or the button mounting member which has been held on the first die or the second die. Therefore, in the invention, supplying or delivering the intermediate material to the first die or the second die includes delivering the intermediate material to the button main body or the button mounting member which has been held by the first die or the second die. Cutting out the intermediate material from the sheet material in the intermediate material formation unit may be done by gas fusion cutting with heat, laser cutting, and plasma cutting, in addition to cutting using a cutting blade such as a cutter.

In the invention, the intermediate material transport unit may hold the intermediate material transported to the button mounting unit on the first die or the second die. In this case, the intermediate material formed by the intermediate material formation unit is transported and then temporarily held to the first die or the second die by the intermediate material transport unit.

In the invention, the intermediate material transport unit may include an intermediate material receiving part configured to receive the intermediate material formed by the intermediate material formation unit, and a first movement mechanism configured to move the intermediate material receiving part between a first position corresponding to the intermediate material formation unit and a second position corresponding to the button mounting unit. The first movement mechanism is a mechanism for moving the intermediate material receiving part between the first position and the second position, and an actuator such as a cylinder, a motor, a robot arm or the like can be used.

In the invention, the intermediate material transport unit may include a second movement mechanism for moving the intermediate material receiving part, at the second position, between an initial position relatively distant from the first die or the second die and a delivery position adjacent to the first die or the second die so as to deliver the intermediate material to the first die or the second die. The second movement mechanism is a mechanism for displacing, at the second position, the intermediate material receiving part between the initial position and the delivery position, and an actuator such as a cylinder, a motor, a robot arm or the like can be used. Note that the initial position relatively distant from the first die or the second die means that the initial position is away from the first die or the second die as compared to the delivery position.

In the invention, the intermediate material formation unit may include a sheet supply unit around which the sheet material is wound in a roll shape, a drive roller configured to send out the sheet material from the sheet supply unit by pulling the sheet material, and a cutting unit provided between the sheet supply unit and the drive roller to cut off the intermediate material from the sheet material. In this case, by pulling the sheet material by rotation of the drive roller, the sheet material is sent out from the sheet supply unit, and the intermediate material is punched out from the sheet material between the sheet supply unit and the drive roller by the cutting blade or the like of the cutting unit. Then, the sheet material after punching of the intermediate material remains in a strip-like form.

In the invention, the first die has an intermediate material holder capable of holding the intermediate material that has an outer form greater than that of the button main body. In this case, since the intermediate material is greater than the button main body, the intermediate material appears around the button main body which has been mounted onto the cloth. Therefore, by appropriately selecting a color, a shape or the like of the intermediate material, it is possible to enhance the design characteristics.

According to another aspect of the invention, there is provided a button mounting method comprising the steps of: A) holding a button main body on a first die and holding a button mounting member on a second die; B) forming an intermediate material by cutting it out from a strip-like sheet material; C) automatically transporting and delivering the intermediate material to the first die or the second die; and D) mounting the button main body onto a cloth with the button mounting member while interposing the intermediate material between the button main body and the cloth or between the button mounting member and the cloth. In the invention, the step B and the step D can be simultaneously performed.

In the invention, when the button main body is mounted onto the cloth with the button mounting member, it is possible to automatically supply the intermediate material and interpose it between the button main body and the cloth or between the button mounting member and the cloth. Therefore, workability of the button mounting is improved.

DETAILED DESCRIPTION OF THE INVENTION

Figure 1:
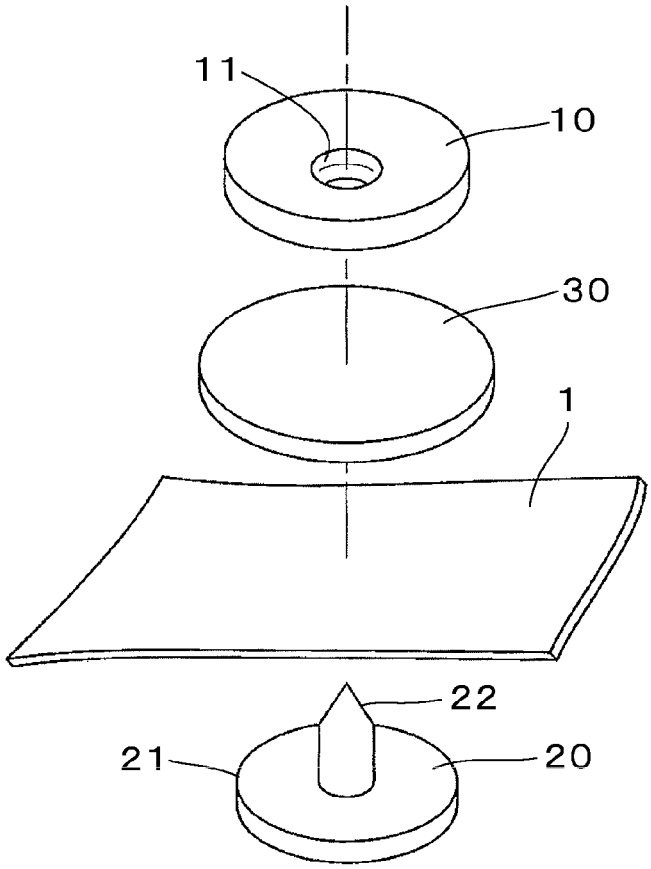
FIG. 1 is a perspective explanatory view illustrating a state in which a button main body, an intermediate material, a cloth, and a button mounting member are vertically and concentrically arranged.
Figure 2:
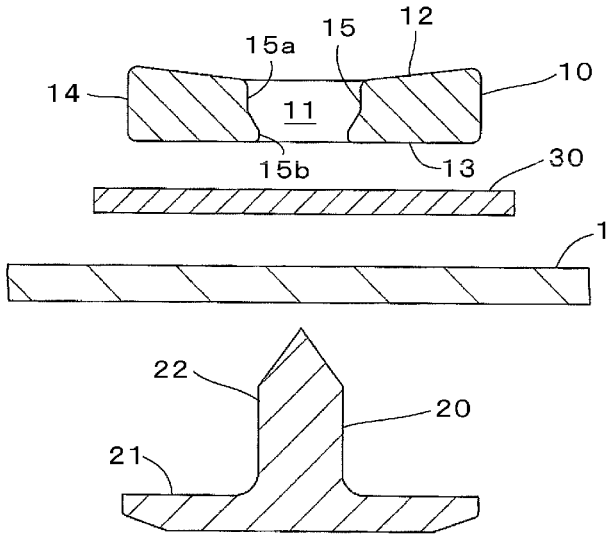
FIG. 2 is a cross-sectional explanatory view of FIG. 1.
Figure 3:
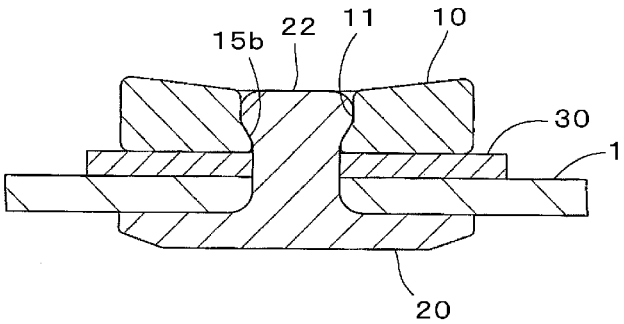
FIG. 3 is a cross-sectional explanatory view illustrating a state in which mounting of the button main body onto the cloth is completed.

Hereinafter, preferred embodiments of a button mounting apparatus according to the invention will be described with reference to the drawings, but the invention is not limited to such embodiments, and various modifications and the like can be made suitably within the scope of the claims. FIG. 1 is a perspective explanatory view illustrating a state in which a button main body 10, a button mounting member 20 and an intermediate material (packing) 30 between the body 10 and the member 20 are vertically and concentrically arranged. The button main body 10 is to be mounted onto a cloth 1 such as a garment by a button mounting apparatus 100 according to the invention (see FIG. 4 or the like). The button mounting member 20 is used for mounting the button main body 10 onto the cloth 1. The intermediate material 20 is interposed between the button main body 10 and the cloth 1 in this example. FIG. 2 is a cross-sectional explanatory view of FIG. 1. FIG. 3 is a cross-sectional explanatory view illustrating a state in which the button main body 10 is completely mounted onto the cloth 1. The button main body 10 is, for example, used for a bar tack, a decoration or the like of a pocket in jeans or the like. The button main body 10 is a metal or resin product having a substantially annular disk shape, and has a mounting opening 11 vertically penetrating at a center thereof (the vertical direction is based on the sheet surfaces of FIGS. 2 and 3). Through the mounting opening 11, a post 22 as described later of the button mounting member 20 passes after the post 22 penetrates the cloth 1 when the button main body 10 is mounted onto the cloth 1. After that the post 22 is swaged. The button main body 10 has an upper surface 12, a horizontal bottom surface 13 (a horizontal surface refers to a certain plane perpendicular to the vertical direction or the axis of the button main body), an outer peripheral surface 14 and an inner peripheral surface 15 defining the mounting opening 11. The upper surface 12 has a gentle slope lowered from the radial outer end to the inner opening 11. The outer peripheral surface 14 extends between the radially outer ends of each of the upper and bottom surfaces 12 and 13 and substantially parallel to the axis of the button main body 11. The inner peripheral surface 15 is divided into an upper half portion 15*a* having a substantially constant diameter, and a lower half portion 15*b* which has a diameter shrinking downward and slightly projects radially inward. The button mounting member 20 is a metal or resin product, and includes a disk-shaped base 21, and a post 22 which extends concentrically with the base 21 from the center of the base 21. The post 22 has a sharpened tip end. When mounting the button main body 10 onto the cloth 1, the post 22 of the button mounting member 20 penetrates the cloth 1 (and an intermediate material 30) upward and then passes through the opening 11 of the button main body 10. After that, the post 22 is swaged by a punch 43 as described later (see FIG. 6 or the like). The swaged post 22 (see FIG. 3) is engaged by the lower half portion 15*b* of the inner peripheral surface 15 of the button main body 10, and thereby the post 22 is prevented from being pulled out of the opening 11 of the button main body 10. The intermediate material 30 is a circular resin sheet having flexibility. In this example, the intermediate material 30 is thinner than the cloth 1 and is formed to have a diameter that is slightly larger than the outer diameter of the button main body 10. For that reason, the radially outer portion of the intermediate material 30 appears annularly around the button main body 10 mounted onto the cloth 1. Thus, it is possible to enhance the design characteristics by suitably selecting the color or shape of the intermediate material 30. The diameter of the intermediate material 30 may be equal to or less than the outer diameter of the button main body 10. The shape of the button main body 10 is not limited to a circular shape, and may be an elliptical shape, a polygonal shape, a star shape or the like. In addition, particularly when the cloth 1 is thin, the intermediate material 30 can serve to support the reliable mounting of the button main body 10 to the cloth 1 by compensating for the cloth thickness.

Figure 4:
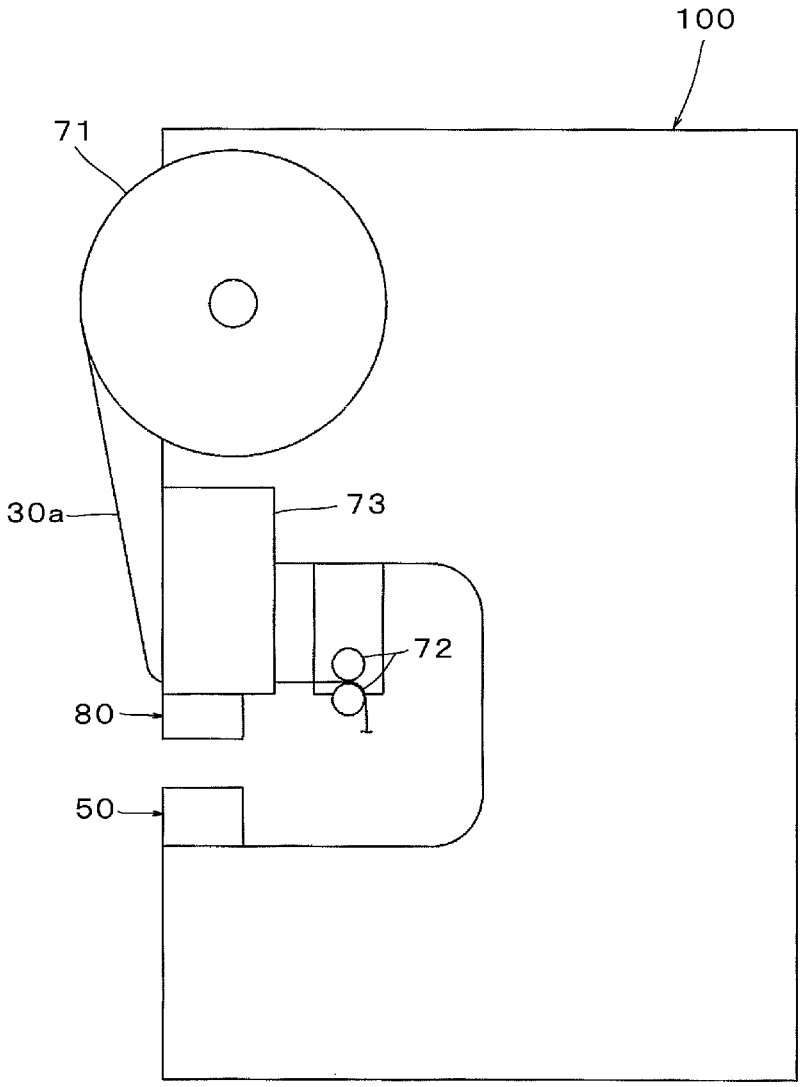
FIG. 4 is a side view schematically illustrating a button mounting apparatus according to an exemplary embodiment of the invention.
Figure 5:
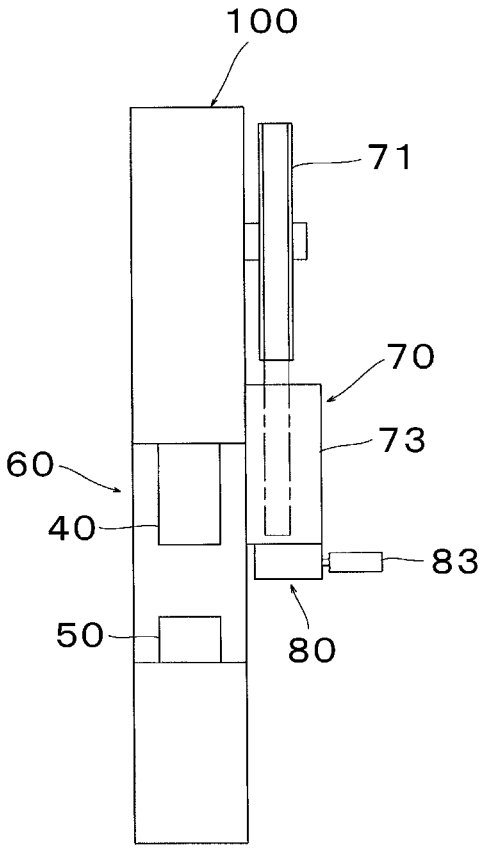
FIG. 5 is a schematic front view of the button mounting apparatus in FIG. 4.
Figure 6:
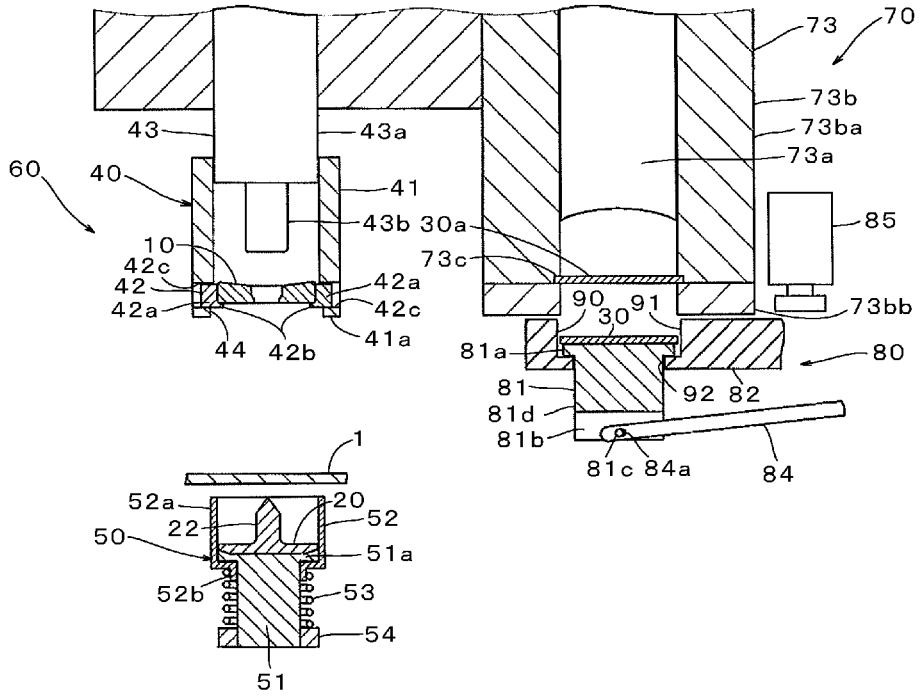
FIG. 6 is an enlarged cross-sectional explanatory view schematically illustrating a main part of the button mounting apparatus, where an intermediate material receiving part is located at a first position.

FIGS. 4 and 5 are a side view and a front view schematically illustrating the button mounting apparatus 100 according to an embodiment of the invention. FIG. 6 is an enlarged cross-sectional explanatory view schematically illustrating a main part of the button mounting apparatus 100. The button mounting apparatus 100 comprises a button mounting unit 60, an intermediate material formation unit 70, and an intermediate material transport unit 80. The button mounting unit 60 includes a first die 40 for holding the button main body 10 and a second die 50 for holding the button mounting member 20 as the button main body 10 is mounted onto the cloth 1. The intermediate material formation unit 70 forms the intermediate material 30 by cutting it out from a strip-like long sheet material 30*a*. The intermediate material transport unit 80 transports the intermediate material 30 formed in the intermediate material formation unit 70 to hold it to the first die 40 which is holding or just before holding the button main body 10. In the button mounting unit 60, the first die 40 is disposed in an upper side, and the second die 50 is disposed in a lower side concentrically below the first die 40. In this example, in a state in which the cloth 1 is placed between the first die 40 and the second die 50 as the button main body 10 is to be mounted onto the cloth 1, the first die 40 is lowered (moves in the direction approaching the second die 50) from the initial position shown in FIG. 6 by an up-and-down unit (not shown) of the button mounting unit 60, while the second die 50 remains stationary. However, in some cases, the second die 50 may move upward. Further, there is also a case where the second die 50 is disposed in an upper side and the first die 40 is disposed in a lower side or a case where the first and second dies 40 and 50 are laterally disposed.

The first die 40 comprises a cylindrical body 41, a button holder 42 incorporated in the vicinity of the lower end of the cylindrical body 41, a punch unit 43 that is vertically movable inside the cylindrical body 41, and an intermediate material holder 44 that is formed, below the button holder 42, on the radially inner side of the lower end 41*a* of the cylindrical body 41. The inner diameter of the cylindrical body 41 is slightly greater than the outer diameter of the button main body 10. The button holder 42 includes two holding members 42*a* and a spring (not shown). The two holding members 42*a* face each other in a diameter direction, and can receive the button main body 10 between them. The spring resiliently biases each of the holding members 42*a* radially inward, which are slightly displaced radially outward from the initial position because of receiving the button main body 10 between the holding members 42*a*. Each of the holding members 42*a* has a projection 42*b* slightly projecting radially inward at its lower end. The projection 42*b* supports the bottom surface 13 of the button main body 10. The upper surface of the projection 42*b* inclines so as to be displaced radially outward against the bias of the spring when the upper surface of the projection 42*b* is pushed downward by the button main body 10. The lower surface of the projection 42*b* is flush with the bottom surface of the holding member 42*a*. Each of the holding members 42*a* is a long circular arch member along the circumferential direction of the cylindrical body 41, and is disposed in two circumferentially long through-holes 42*c* provided near the lower end of the cylindrical body 41. The cylindrical body 41 has a button introduction port (not shown) between the two through-holes 42*c*, and is adapted to receive the button main body 10, which is supplied from an automatic supply device (not shown), through the button introduction port to between the two holding members 42*a*. The button main body 10A may be manually held to the button holder 42 by a worker from below. In this case, by inclining the lower surface of the projection 42*b* of the holding member 42*a*, it is possible to easily hold the button main body 10.

The lower end 41*a* below the through-hole 42*c* of the cylindrical body 41 has an inner diameter that is slightly expanded compared to that of the cylindrical body 41*a* above the through-hole 42*c*. The inner peripheral surface of the lower end 41*a* having the expanded diameter and the lower surfaces of the holding members 42*a* define an intermediate material holder 44 that is recessed upward. The diameter of the intermediate material holder 44 is designed to be greater than the outer diameter of the button main body 10 and to be slightly smaller than the diameter of the intermediate material 30. Thus, the intermediate material 30 having flexibility can be fitted into the intermediate material holder 44 (see FIG. 9 or the like) to be temporarily held. As another method of temporarily holding the intermediate material 30 below the button main body 10 in the first die 40, it is possible to apply adhesive on the upper surface of the sheet material 30*a* in advance and then to stick the sheet material 30*a* on the button main body 10 held by the first die 40, thereby temporarily holding the intermediate material 30. Otherwise, it is also possible to stick the intermediate material 30 with adhesive to the first die 40. The punch 43 has a columnar punch base 43*a* and a columnar punch main body 43*b*. The punch base 43*a* is vertically movable within the cylindrical body 41 and has an outer diameter substantially equal to the inner diameter of the cylindrical body 41. The columnar punch main body 43*b* extends downward from the bottom surface of the punch base 43*a* concentrically and has a diameter smaller than the punch base 43*a*. In the above, since the button main body 10 and the intermediate material 30 have a circular shape, their outer forms are based on their diameters. However, in an elliptical shape, a polygonal shape, and a star shape as described above, their outer forms are defined by their outlines. Further, in holding of the intermediate material 30 by the intermediate material holder 44, it is preferable to hold over the entire area of an outer form but it is possible to partially hold the outer form. For example, as partial holding, an outer form can be held at opposing two points or at three points.

The second die 50 comprises a substantially columnar supporter 51, a substantially cylindrical cloth supporter 52, a coil spring 53 that is wound around the supporter 51 and a spring receiver 54 for the coil spring 53. The button mounting member 20 is placed on the upper surface of the supporter 51. The cloth supporter 52*a* surrounds the periphery of the button mounting member 20 placed on the supporter 51, and supports the cloth 1 as the button main body 10 is being mounted. The coil spring 53 elastically supports the cloth supporter 52. The spring receiver 54 is fixed at a lower side of the supporter 51. The supporter 51 has an upper end portion 51*a* having an enlarged outer diameter, and the outer diameter of the upper end portion 51*a* is equal to or slightly greater than the outer diameter of the base 21 of the button mounting member 20. The cloth supporter 52 includes a cylindrical support unit main body 52*a* and a support unit base portion 52*b*. The support unit main body 52*a* has an inner diameter substantially equal to the outer diameter of the upper end portion 51*a* of the supporter 51. The support unit base portion 52*b* is reduced in diameter from the lower end of the support unit main body 52*a* in a stepped manner and then slightly extends downward. At the initial state, the support unit base portion 52*b* is biased upward by the coil spring 53, and is stationary hitting the lower surface of the upper end portion 51*a* of the supporter 51. At this initial state, the upper end of the support unit main body 52*a* is at the same height as the tip end of the post 22 of the button mounting member 20 placed on the supporter 51. In the second die 50, the button mounting member 20 is supplied onto the supporter 51 from an automatic supply device (not shown). Note that, in some cases, a worker may set manually the button mounting member 20 on the supporter 51.

The intermediate material formation unit 70 comprises a sheet supply unit 71, a pair of drive rollers 72 and a cutting unit 73. Around the sheet supply unit 71, the strip-shaped sheet material 30*a* is wound in a roll shape. The drive rollers 72 pull the sheet material 30*a* from the sheet supply unit 71 to supply it. The cutting unit 73 is provided between the sheet supply unit 71 and the drive roller 72 to punch the intermediate material 30 in a circular form from the sheet material 30*a*. The sheet material 30*a* has a width that is slightly greater than the diameter of the intermediate material 30. The drive roller 72 is rotationally driven by a motor as not shown. The cutting unit 73 comprises a cylindrical cutting blade 73*a* having a sharp circular edge at a lower end, and a cylindrical housing 73*b* that houses the cutting blade 73*a* and has a sheet passage 73*c* through which the sheet material 30*a* passes horizontally. The cutting blade 72*a* can move up and down within the housing 73*b* by a cylinder as not shown and the like. The housing 73*b* has an inner diameter substantially equal to the outer diameter of the cutting blade 73*a*, and opens downward. The sheet material 30*a* passes through the sheet passage 73*c* from the front in the sheet surface of FIG. 6 to the back (rear). Hereinafter, the front-and-back direction in the FIG. 6 sheet surface is referred to as "the front-and-back direction." In the cross-section of FIG. 6 or the like, the sheet passage 73*c* appears as a groove provided on the inner peripheral surface of the housing 73*b*, but the sheet passage 73*c* passes through the housing 73*b* in the front-and-back direction. The housing 73*b* includes an upper housing main body 73*ba*, and an annular portion 73*bb* having an upper surface in contact with the bottom surface of the housing main body 73*ba*. There formed a recess on the bottom surface of the housing main body 73*ba*, the recess defining the sheet passage 73*c*. The circular intermediate material 30 is punched out from the sheet material 30*a* by lowering the cutting blade 73*a* to the sheet material 30*a* that is passing through the sheet passage 73*c* as shown in an enlarged view of FIG. 13. Then, the cut intermediate material 30*d* drops on an intermediate material receiving part 81 of an intermediate material transport unit 80 as described below. Since the size (diameter) of the cut intermediate material 30 is smaller than the width of the sheet material 30*a*, the strip-shaped sheet material 30*a* after the intermediate materials 30 have been cut can be pulled to the drive roller 72 while remaining in the strip shape. The strip-shaped sheet material 30*a* can be wound by a winding unit as not shown or collected in a box downstream of the drive roller 72, and be recycled. Furthermore, the drive roller 72 may be a winding unit.

The intermediate material transport unit 80 comprises a substantially columnar intermediate material receiving part 81, a support member 82, a horizontal cylinder 83 (see FIG. 5), an operating rod 84, and a vertical cylinder 85. The intermediate material receiving part 81 receives, on its upper surface, the intermediate material 30 cut off from the sheet material 30*a* at the intermediate material formation unit 70. The support member 82*a* is long in the left-and-right direction (the left-and-light is based on the sheet surfaces of FIGS. 6, 7, etc., and is the direction perpendicular to the front-and-back direction), and supports, on its left end, the intermediate material receiving part 81. The horizontal cylinder 83 moves the support member 82 horizontally between a first position (see FIG. 6) at which the intermediate material receiving part 81 comes directly below the housing 73*b* of the intermediate material formation unit 70 and a second position (see FIG. 7) at which the intermediate material receiving part 81 comes directly below the first die 40 of the button mounting unit 60. The left end of the operating rod 84 is connected to the lower end of the intermediate material receiving part 81. Further, the midpoint in the left-and-right direction of the rod 84 is pivotally connected to an intermediate support part 82*e* (see FIG. 7) which is integrated with the support member 82. The vertical cylinder 85 lowers the right end of the operating rod 84 in order to lift the left end of the operating rod 84 when the support member 82 is located at the second position. Thereby, the intermediate material 30 on the intermediate material receiving part 81 is delivered to the intermediate material holder 44 of the first die 40. The intermediate material receiving part 81 becomes concentric with the cutting blade 73*a* and the like at the first position, and becomes concentric with the first die 40 at the second position. The support member 82, the horizontal cylinder 83 and the like for horizontally moving the intermediate material 30 between the first and second positions constitute a first movement mechanism in the claims. The operating rod 84, the vertical cylinder 85, an intermediate material storing space 91 as described later of the support member 82 and the like for lifting the intermediate material 30 at the second position constitute a second transport mechanism in the claims.

The intermediate material receiving part 81 has an upper end portion 81*a* having a slightly enlarged outer diameter. The intermediate material 30 is transported while being placed on the upper surface of the upper end portion 81*a*. The outer diameter of the upper end portion 81*a* is slightly smaller than the outer diameter of the intermediate material 30. There is formed a recess 81*b* in the lower end portion of the intermediate material receiving part 81, the recess 81*b* penetrating the unit 81 in the left-and-right direction and being open downward. The left end of the operating rod 84 is inserted into the recess 81*b*, and the operating rod 84 is connected to the intermediate material receiving part 81 by passing an axis member 81*c* provided at the midpoint in the left-and-right direction and a lower side in the recess 81*b* through a left axis hole 84*a* formed at the left end of the operating rod 84. The support member 82 includes, in its left end portion, an opening 90 which vertically penetrates the member 82 for receiving and supporting the intermediate material receiving part 81. The opening portion 90 is divided into an upper intermediate material storing space 91 and a lower receiving part support opening 92. The intermediate material storing space 91 has a diameter slightly greater than the outer diameter of the intermediate material 30. The receiving part support opening 92 is reduced in diameter below the intermediate material storing space 91 in a stepped manner, and has a diameter slightly greater than the outer diameter of a part (hereinafter, referred to as "the receiving part main body 81*d*") of the intermediate material receiving part 81*a* excepting the upper end portion 81*a*. The intermediate material storing space 91 is defined by a peripheral side surface 91*a* and an annular bottom surface 91*b* (see FIG. 8). When the intermediate material receiving part 81 is located at the first position, the intermediate material storing space 91 serves to surely place the intermediate material 30 discharged from the housing 73*b* of the intermediate material formation unit 70 on the intermediate material receiving part 81. Further, when the intermediate material receiving part 81 is located at the second position, the intermediate material storing space 91 serves as a guide for moving the upper end portion 81*a* of the intermediate material receiving part 81 upward as described below. The receiving part main body 81*d* projects downward through the receiving part support opening 92 and the upper end portion 81*a* of the intermediate material receiving part 81 is caught on the bottom surface 91*b* of the intermediate material storing space 91, so that the intermediate material receiving part 81 is supported. There is provided an intermediate axis member 82*f* on the intermediate support part 82*e* of the support member 82, and the intermediate axis member 82*f* passes through an intermediate axis hole 84*b* formed at the midpoint in the left-and-right direction of the operating rod 84. Thereby, the operating rod 84 is rotatable about the intermediate axis member 82*f*. In the initial state in which the vertical cylinder 85 is not operated, the left end side of the operating rod 84 inclines with respect to the horizontal state so as to be lowered compared to the right end side. In addition, when the vertical cylinder 85 is operated, the right end side is lowered and the left end side rises, approaching almost the horizontal state.

Figure 7:
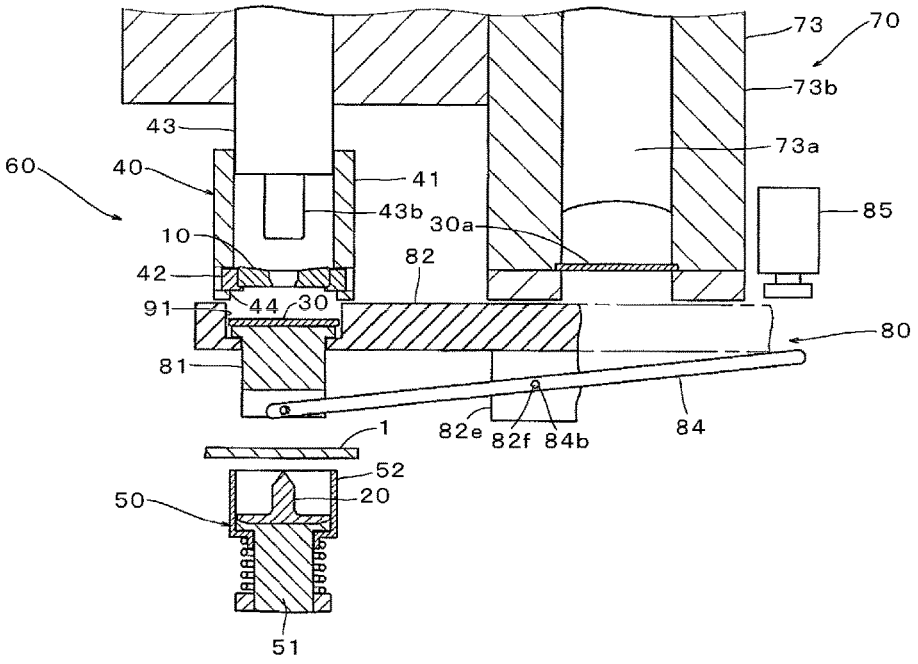
FIG. 7 is a cross-sectional explanatory view illustrating a state in which the intermediate material receiving part has been moved to a second position from the FIG. 6 state.
Figure 8:
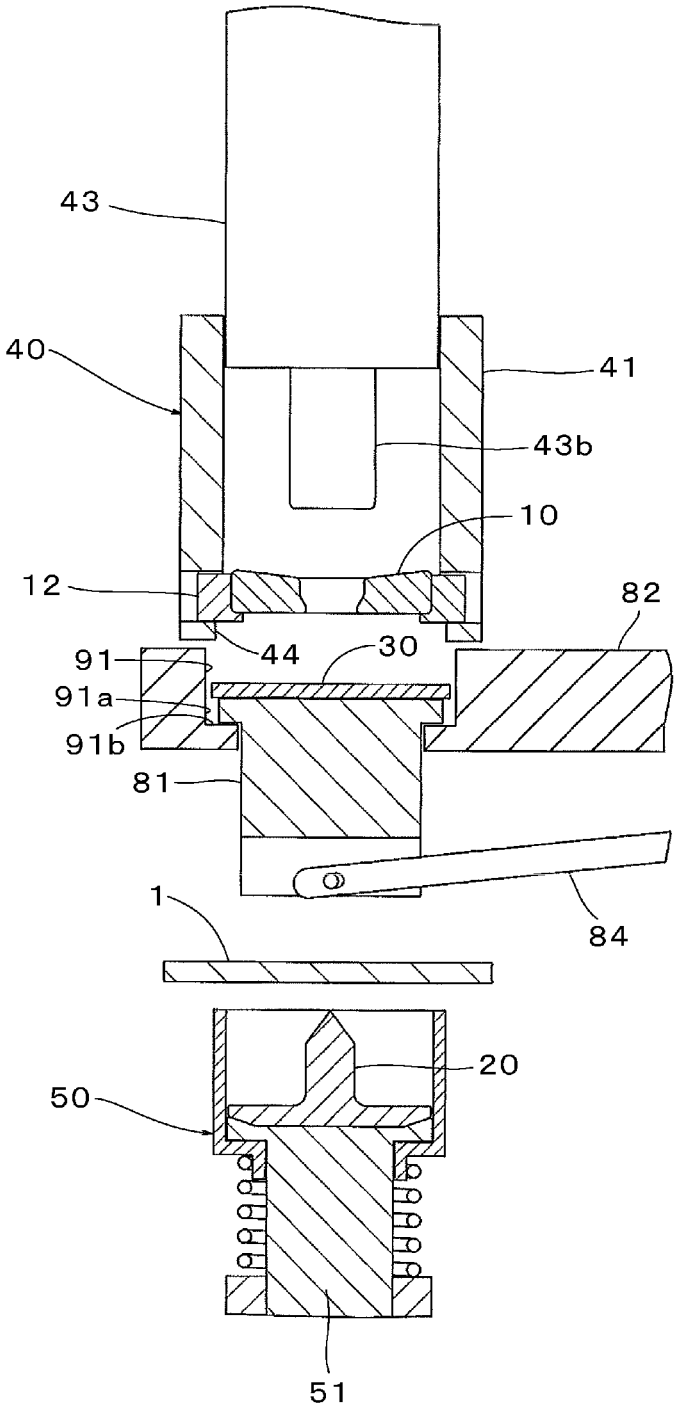
FIG. 8 is an enlarged cross-sectional explanatory view illustrating the button mounting unit in FIG. 7, in which the intermediate material receiving part is located at an initial position at the second position.
Figure 9:
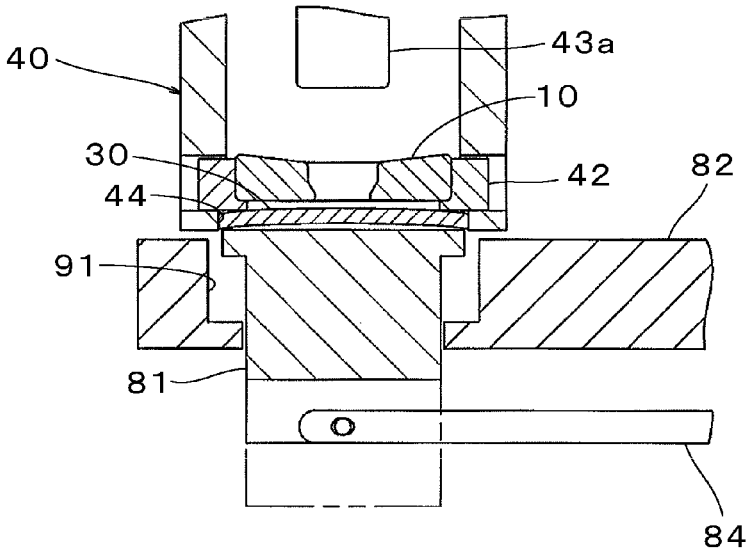
FIG. 9 is an enlarged cross-sectional explanatory view illustrating a state in which the intermediate material receiving part has been moved to a delivery position at the second position.
Figure 10:
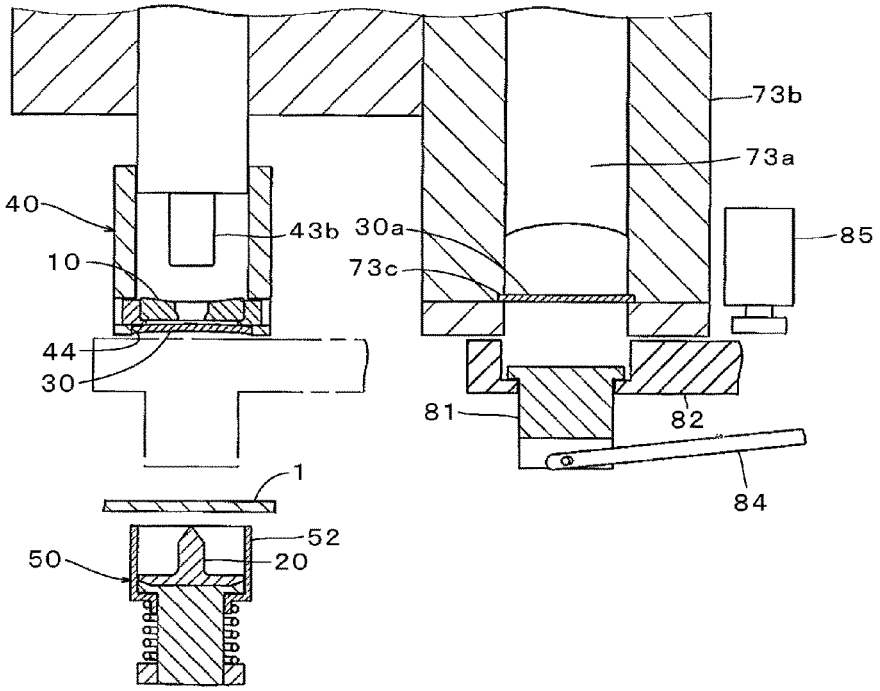
FIG. 10 is a cross-sectional explanatory view illustrating a state in which the intermediate material support unit has returned to the first position from the second position.

Next, a process of mounting the button main body 10 onto the cloth 1 using the button mounting apparatus 100 configured as described above will be explained. The button mounting unit 60 in FIG. 6 is in a state in which the first die 40 and the second die 50 are at the initial position. In addition, in the state, the button main body 10 and the button mounting member 20 are supplied to the first die 40 and the second die 50 from the automatic supply devices, respectively, and are held thereon. This state can also be a state in which the previous work of the continuously performed mounting work of the button main body 10 onto the cloth 1 has been finished, and the first and second dies 40 and 50 have returned to the initial position and just received the button main body 10 and the button mounting member 20 for the next mounting work. In the intermediate material formation unit 70 in FIG. 6, the cutting blade 73*a* dropt to the sheet material 30*a* passing through the sheet passage 73*c* to punch the intermediate material 30 out, and the intermediate material 30 has been placed on the intermediate material receiving part 81 located at the first position through the intermediate material storing space 91 of the support member 82 of the intermediate material transport unit 80. The cutting blade 73*a* has risen and returned to the initial position. The intermediate material 30 is transported to the first die 40 as follows. First, by operating the horizontal cylinder 83, the support member 82 of the intermediate material transport unit 80 horizontally moves to the left side as shown in FIG. 7 and the intermediate material receiving part 81 moves to the second position. The intermediate material receiving part 81 right after the movement is located at the initial position in the second position lower in the vertical direction. FIG. 8 is an enlarged cross-sectional explanatory view illustrating the button mounting unit 60 in FIG. 7. Next, by operating the vertical cylinder 85, the operating rod 84 rotates in the clockwise direction about the intermediate axis member 82*f*, and the left end of the operating rod 84 rises from the initial position. Thus, as shown in FIG. 9, the intermediate material receiving part 81 is lifted through the intermediate material storing space 91 of the support member 82 and is displaced to a delivery position upper in the vertical direction in the second position. At the delivery position, the intermediate material 30 on the intermediate material receiving part 81 is fitted and held onto the intermediate material holder 44 of the first die 40. Thereafter, the intermediate material receiving part 81 returns to the initial position in the second position, and subsequently returns to the first position as shown in FIG. 10.

Figure 11:
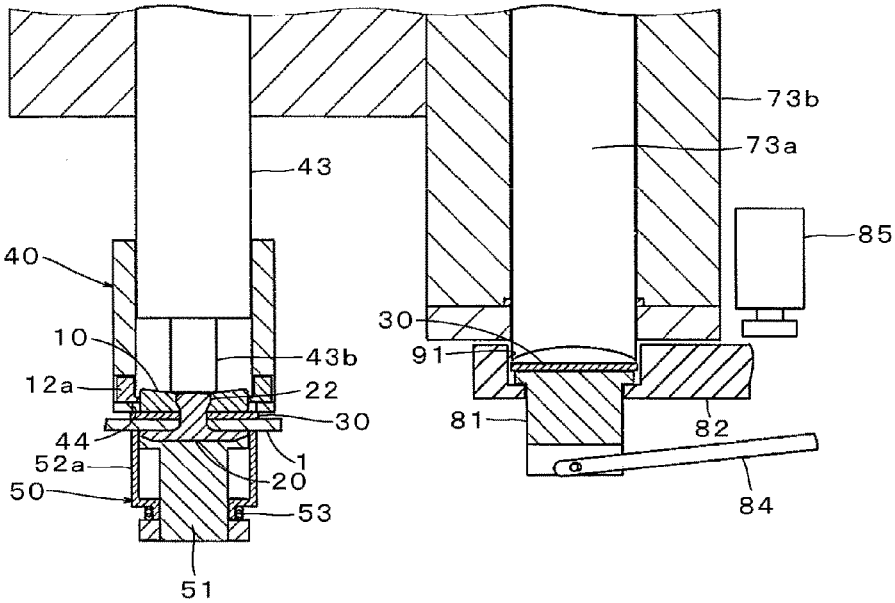
FIG. 11 is a cross-sectional explanatory view illustrating a state in which a lowering of a first die in the button mounting unit and a lowering of a cutting blade in the intermediate material formation unit are simultaneously performed.
Figure 12:
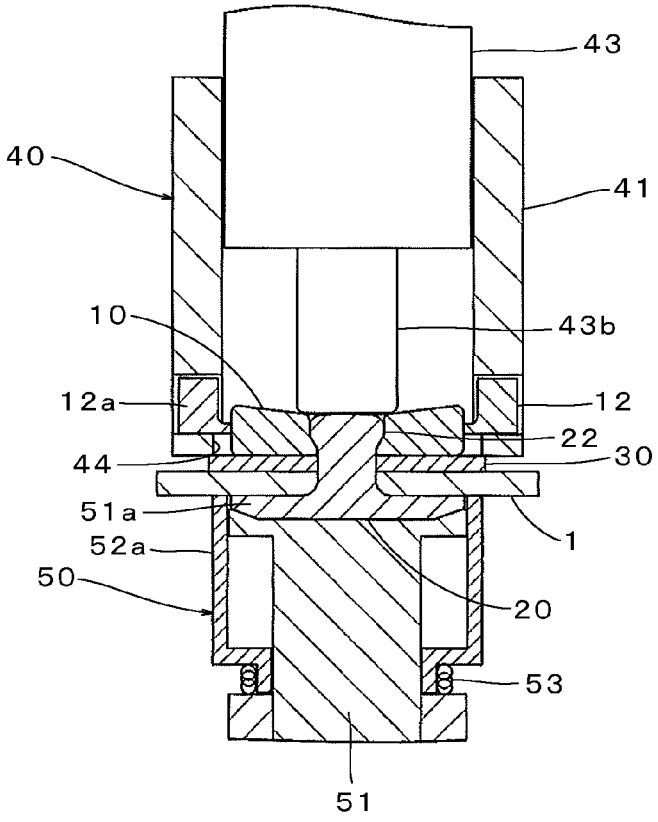
FIG. 12 is an enlarged cross-sectional explanatory view illustrating a state in which a post of the button mounting member is swaged to mount the button main body onto the cloth.
Figure 13:
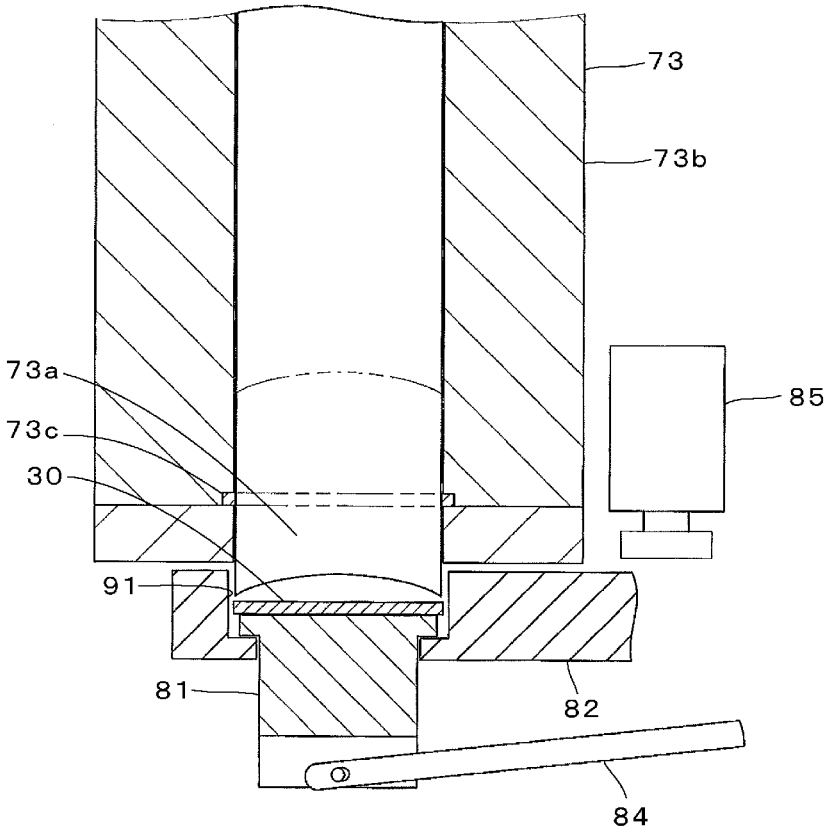
FIG. 13 is an enlarged cross-sectional explanatory view illustrating a state in which the intermediate material is cut out by the cutting blade and fed onto the intermediate material receiving part.

Next, as shown in FIG. 11, the work of mounting the button main body 10 onto the cloth 1 is performed by lowering the upper die 40 in the button mounting unit 60. At the same time, in the intermediate material formation unit 70, the cutting blade 73*a* drops to cut out the next intermediate material 30. In the button mounting unit 60, by the lowering of the first die 40 with the button main body 10 and the intermediate material 30 held, the post 22 of the button mounting member 20 passes through the cloth 1 and then the intermediate material 30. Thereby, the post 22 projects above the button main body 10 through the opening 11 of the button main body 10. As illustrated in FIG. 12, the projected post 22 is swaged by the punch main body 43*b* of the punch 43 of the first die 40. Thus, the button main body 10 is fixed to the cloth 1 in a state in which the intermediate material 30 is interposed between the button main body 10 and the cloth 1. During the swaging, since the button main body 10 is pushed downward by the punch main body 43, the holding of the button main body 10 by the holding member 42*a* of the button holder 42 is released, and the intermediate material 30 is also discharged from the intermediate material holder 44. In addition, at the time of button-mounting, the cloth supporter 52 of the second die 50 is pushed downward by the cloth 1 and is displaced downward against the bias of the coil spring 53. FIG. 13 is an enlarged view illustrating a state in which the cutting blade 73*a* in the intermediate material formation unit 70 drops to cut out the intermediate material 30 from the sheet material 30*a* and is fed onto the intermediate material receiving part 81. The cutting blade 73*a* projects downward from the lower end of the housing 73*b* in the state of being lowered the most, and enters the intermediate material storing space 91 of the support member 82.

Figure 14:
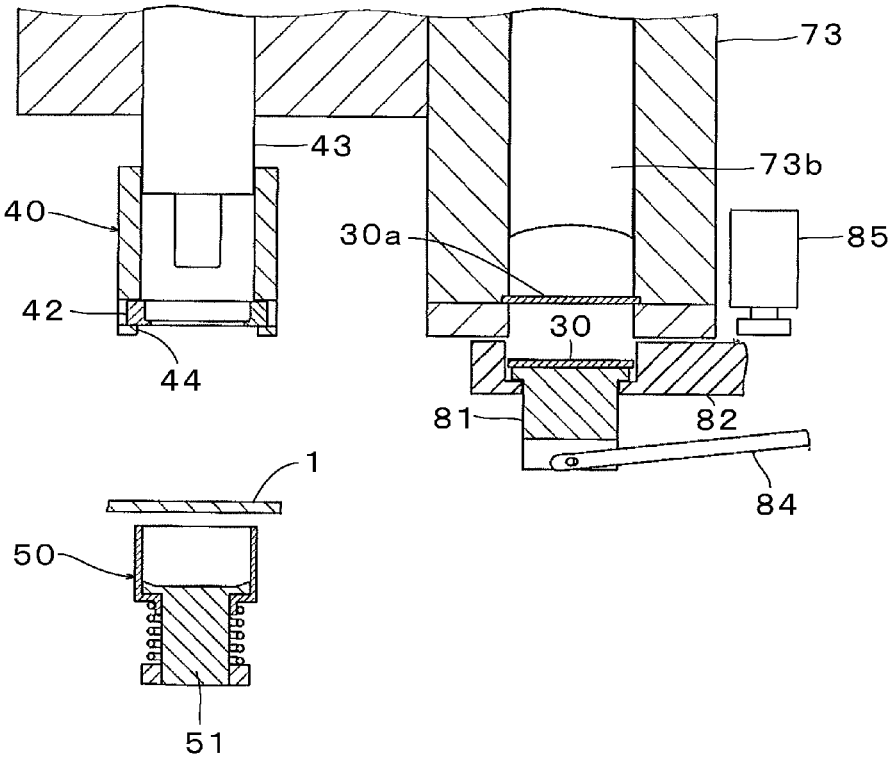
FIG. 14 is a cross-sectional explanatory view illustrating a state in which the first die and the cutting blade have returned to their respective upper initial positions after the FIG. 11 state.

FIG. 14 illustrates a state in which the first die 40 and the cutting blade 73*a* return to their respective upper initial positions, after the button mounting by the lowering of the first die 40 in the button mounting unit 60, the forming of the intermediate material 30 by the drop of the cutting blade 73*a* in the intermediate material formation unit 70 and the providing of the intermediate material 30 to the intermediate material receiving part 81 as shown in FIG. 11. At this time, in the button mounting unit 60, the position of the cloth 1 where the button main body 10 has been mounted is displaced by a worker or a machine, and a new mounting position of the cloth 1 is set above the second die 50. Further, although the first die 40 and the second die 50 do not hold the button main body 10 and the button mounting member 20 which have been discharged yet and which were held before mounting, the button main body 10 and the button mounting member 20 are automatically supplied to the first and second dies 40 and 50, respectively substantially at the same time as the first and second dies 40 and 50 return to their initial positions. In the intermediate material formation unit 70, the sheet material 30*a* moves and the next cutting position comes just below the cutting blade 73*a*. Thereafter, the above-described operations will be repeated such that the intermediate material receiving part 81 moves from the first position to the second position and then from the initial position to the delivery position in the second position. In the button mounting apparatus 100, when mounting the button main body 10 to the cloth 1 with the button mounting member 20, the intermediate material 30 can be automatically formed by the intermediate material formation unit 70, and be interposed between the button main body 10 and the cloth 1 or between the button mounting member 20 and the cloth 1 by automatically supplying the intermediate material 30 to the button mounting unit 60 using the intermediate material transport unit 80. Therefore, the efficiency of the work of mounting the button main body 10 with the intermediate material 30 onto the cloth 1 is increased.

Figure 15:
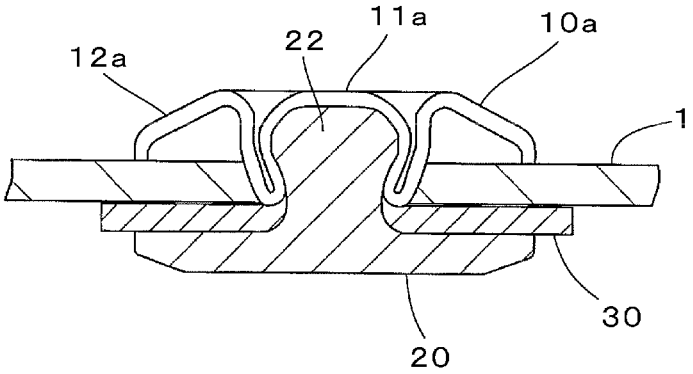
FIG. 15 is a cross-sectional explanatory view illustrating an example in which the intermediate material is disposed between the button mounting member as the button main body is mounted onto the cloth.

In the above embodiment, an example of interposing the intermediate material 30 between the button main body 10 and the cloth 1 was described, but in the invention, it is also possible to dispose the intermediate material 30 between the button mounting member 20 and the cloth 1. In this case, for example, the first die 40 can be disposed in a lower side and the second die 50 can be disposed in an upper side. FIG. 15 is a cross-sectional explanatory view illustrating a state in which a decorative button main body 10*a* is mounted onto the cloth 1 with the button mounting member 20. Here, the intermediate material 30 is placed between the button mounting member 20 and the cloth 1. Since the cloth 1, the button mounting member 20, and the intermediate material 30 are substantially the same as those in FIG. 1 etc., the same reference numerals are used in FIG. 15. The button main body 10*a* is formed by drawing a metal plate, and comprises an upward convex hemispherical central swell 11*a* and a flange 12*a*. The central swell 11*a* defines, its inside, an inner space for receiving and deforming the post 22 of the button mounting member 20 having passing through the cloth 1. The flange 12*a* extends upward from the lower end of the central swell 11*a* and then extends outward in the radial direction. The lower end of the central swell 11*a* slightly reduces inward in the radial direction to be a stopper to prevent the deformed post 22 of the button mounting member 20 from coming off.

Figure 16:
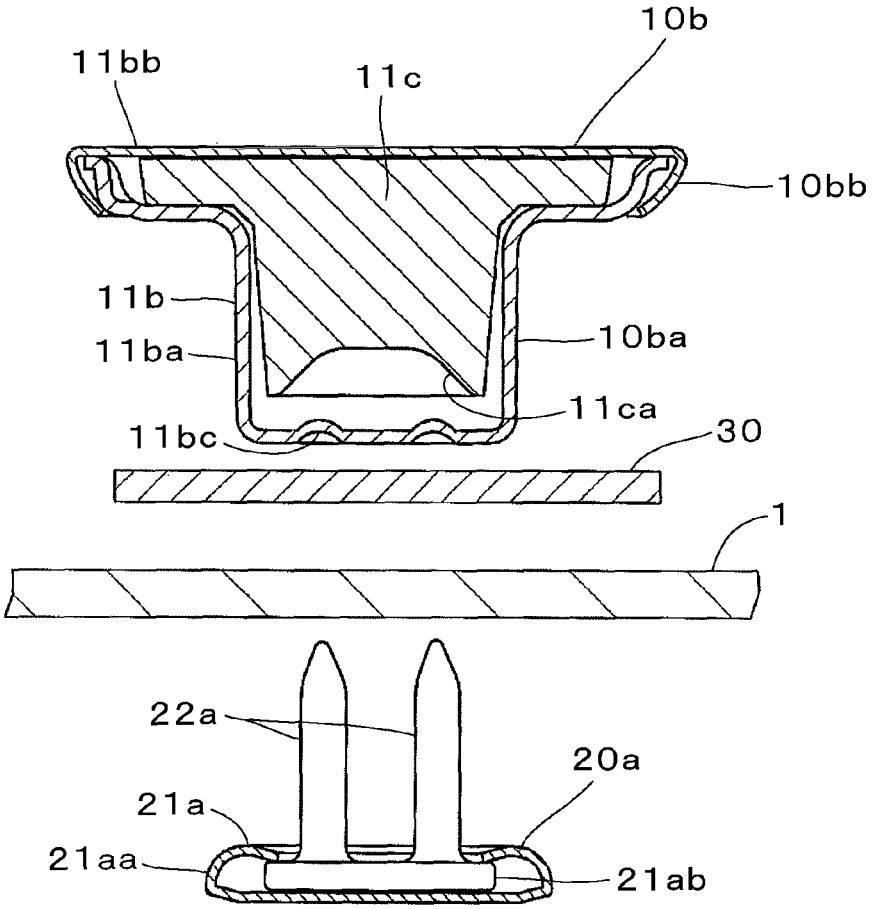
FIG. 16 is a cross-sectional explanatory view illustrating another example of a set of a button main body and a button mounting member capable of being mounted by the button mounting apparatus according to the invention.

FIG. 16 is a cross-sectional explanatory view illustrating another example of a set of a button main body and a button mounting member capable of being mounted by the button mounting apparatus according to the invention. Since the cloth 1 and the intermediate material 30 are substantially the same as those in FIG. 1 etc., the same reference numerals are used in FIG. 16. The button main body 10*b* shown in FIG. 16 includes a cylindrical barrel 10*ba*, and a head 10*bb* having an outer diameter expanding radially outward above the barrel 10*ba*. The head 10*bb* gets in and out of a buttonhole (not shown) of a garment or the like. Furthermore, the button main body 10*b* has an outer metal shell 11*b* and a resin core 11*c*. The outer shell 11*b* includes an outer shell barrel 11*ba* and an outer shell head 11*bb*. The outer shell barrel 11*ba* forms the bottom and the peripheral side of the barrel 10*ba* and the lower surface and the side of the head 10*bb*. The outer shell head 11*bb* forms the upper surface and the side of the head 10*bb*. The part of the outer shell head 11*bb* corresponding to the side of the head 10*bb* is connected to the part of the outer shell barrel 11*ba* corresponding to the side of the head 10*bb* by overlapping from outside. The button mounting member 20*a* has a base 21*a*, and two pins 22*a* projecting from the base 21*a*. The base 21*a* includes an outer metal shell 21*aa* and a resin or metal core 21*ab* integral with the pins 22*a*. There is provided a recess 11*ca* from the bottom of the core 11*c* of the button main body 10*b*. The recess 11*ca* receives and bends the pins 22*a* of the button mounting member 20*a* that have penetrated the cloth 1, the intermediate material 30 and then the bottom of the outer shell barrel 11*ba*. On the bottom of the outer shell barrel 11*ba* of the button mounting member 20*a*, an annular recess 11*bc* recessed upward is formed in order to allow the pin 22*a* to easily pass through the bottom. It is also possible to automatically supply the intermediate material 30 to the button main body 10*b* and the button mounting member 20*a* during mounting to the cloth 1 as described above, and to interpose the intermediate material 30 between the button main body 10*b* and the cloth 1 or between the button mounting member 20*a* and the cloth 1. However, the button main body 10 (10*a* and 10*b*) and the button mounting member 20 (20*a*) may be manually mounted to the first die 40 and the second die 50. In this case, the intermediate material 30 is waiting in a state in which it is held by the intermediate material transport unit 80 until the button main body 10 and the button mounting member 20 are held to the first die 40 and the second die 50 by a worker. Further, when the holding of the button main body 10 and the button mounting member 20 to the first and second dies 40 and 50 is completed, the worker turns on a switch to operate the intermediate material transport unit 80 to transport and hold the intermediate material 30 to the first die 40 or the second die 50. Thereafter, the button main body 10 is mounted onto the cloth 1 with the button mounting member 20. In this example, since the button main body 10 and the button mounting member 20 are not automatically supplied to the first die 40 and the second die 50 but are manually held thereto, the operation of the intermediate material transport unit 80 is performed by the switch. In addition, by pressing the switch, it is possible to automatically perform the operation of transporting the intermediate material 30 to hold it to the first die or the like, and the subsequent mounting of the button main body 10 onto the cloth 1.

Figure 17:
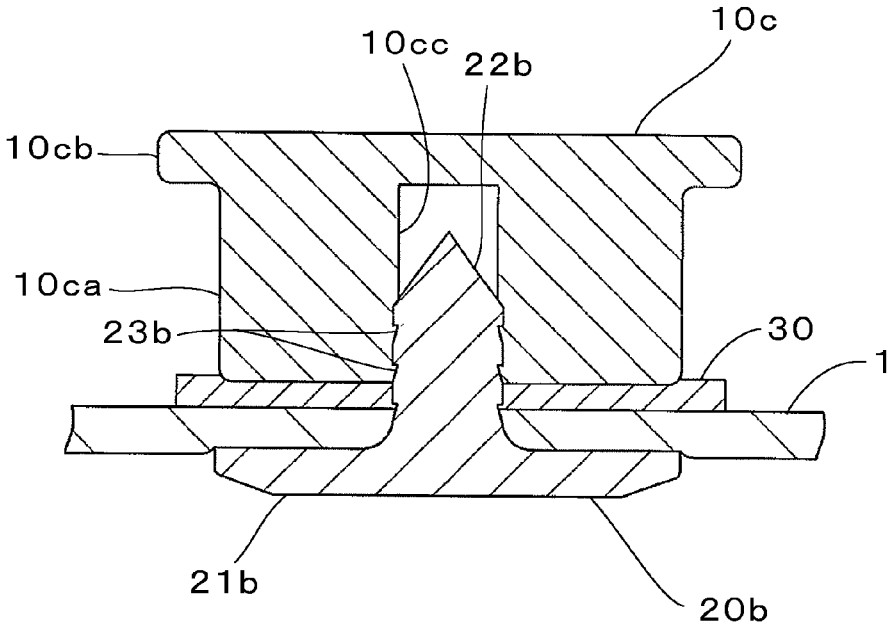
FIG. 17 is a cross-sectional explanatory view illustrating still another example of a set of a button main body and a button mounting member capable of being mounted by the button mounting apparatus according to the invention.
Figure 18:
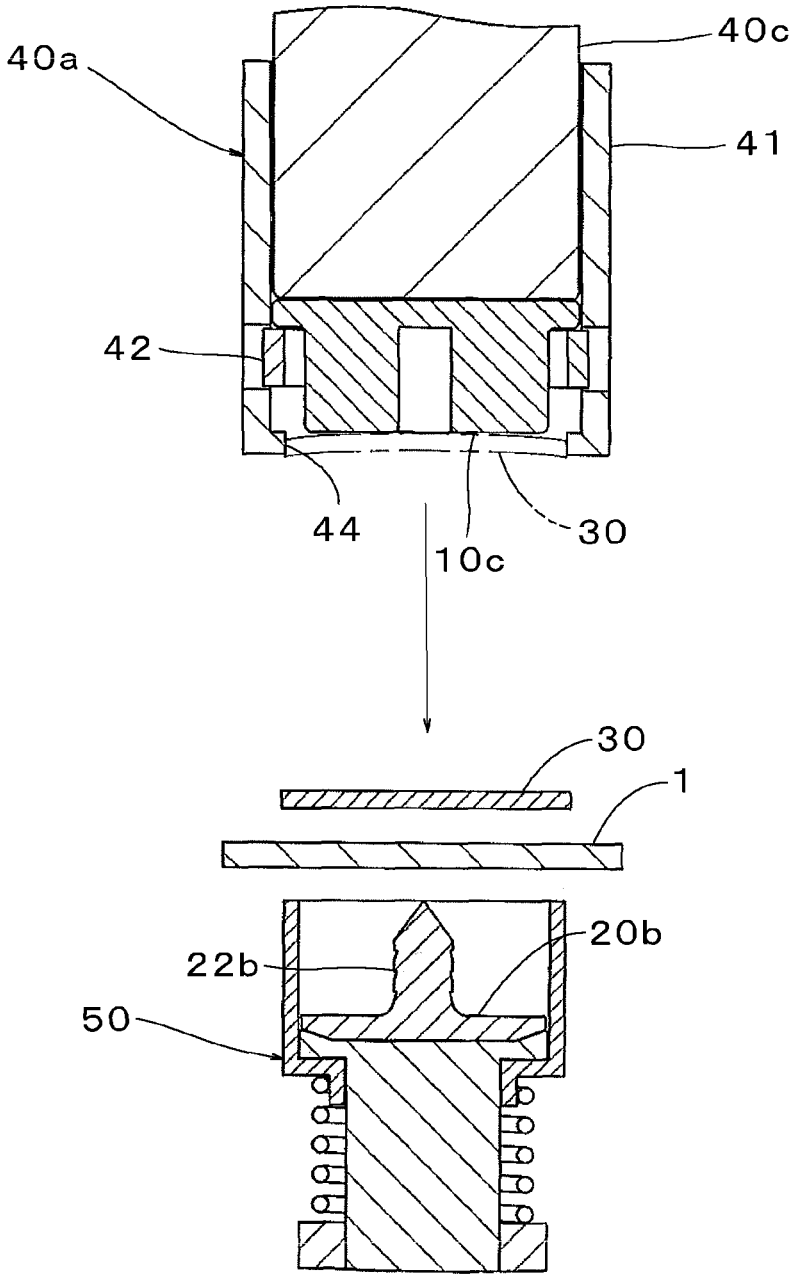
FIG. 18 is a cross-sectional explanatory view schematically illustrating a first die and a second die to which the button main body and the button mounting member in FIG. 17 have been held, respectively.

In the above examples, the button main body 10, 10*a*, 10*b* is mounted to the cloth 1 with the intermediate material 30 by swaging the post 22 or the pins 22*a* of the button mounting member 20, 20*a*. However, there is also a case where a button main body is mounted to the cloth with the intermediate material without swaging a part of a button mounting member. FIG. 17 is a cross-sectional explanatory view illustrating the button main body 10*c* and the button mounting member 20*b* which are mounted to the cloth 1 using the button mounting apparatus 100, with the intermediate material 30 placed between the button main body 10*c* and the cloth 1. Since the cloth 1 and the intermediate material 30 are substantially the same as those in FIG. 1 etc., the same reference numerals are used in FIG. 17. The button main body 10*c* is made of resin, and has a cylindrical barrel 10*ca* and a head 10*cb* having an outer diameter expanding radially outward above the barrel 10*ca*. The head 10*cb* gets in and out of a buttonhole (not shown) of a garment or the like. In the central portion of the barrel 10*ca*, there is formed an inner hole 10*cc* extending upward from the bottom for receiving a post 22*b* (to be described later) of the button mounting member 20*b*. The inner hole 10*cc* is open downward but does not penetrate upward. The button mounting member 20*b* is also made of resin, and has a disk-like base 21*b* and one post 22*b* projecting from the central portion of the base 21*b*. The outer diameter of the post 22*b* is slightly greater than the diameter of the inner hole 10*cc* of the button main body 10*c*. On the outer peripheral surface of the post 22*b*, there are formed, as an example, three annular grooves 23*b*, in the axial direction, each having a right triangular cross-section. FIG. 18 is a cross-sectional explanatory view schematically illustrating a first die 40*a* and the second die 50 which hold the button main body 10*c* and the button mounting member 20*b*, respectively. Since the first die 40*a* is substantially the same as the first die 40 as described above, except that the die 40*a* includes a columnar support member 40*c* in place of the punch 43, the same reference numerals are used as to the cylindrical body 41, the button holder 42, and the intermediate material holder 44. When the button main body 10 is mounted onto the cloth 1, after the intermediate material 30 is held on the intermediate material holder 44 of the first die 40*a* by the intermediate material transport unit 80 in the button mounting apparatus 100, the first die 40*a* is lowered. Thereby, the post 22*b* of the button mounting member 20*b* penetrates the cloth 1 and the intermediate material 30 upward, and then the post 22*b* enters the inner hole 10*cc* of the button main body 10*c*. At this time, the button main body 10*c* is supported by the support member 40*c* from above, and the post 22*b* having the diameter slightly greater than the inner hole 10*cc* is connected to the peripheral surface of the inner hole 10*cc* in a wedge manner, while being deformed so as to be slightly reduced in diameter through the annular grooves 23*b*. In this way, the button main body 10*c* and the intermediate material 30 are fixed to the cloth 1.

Figure 19:
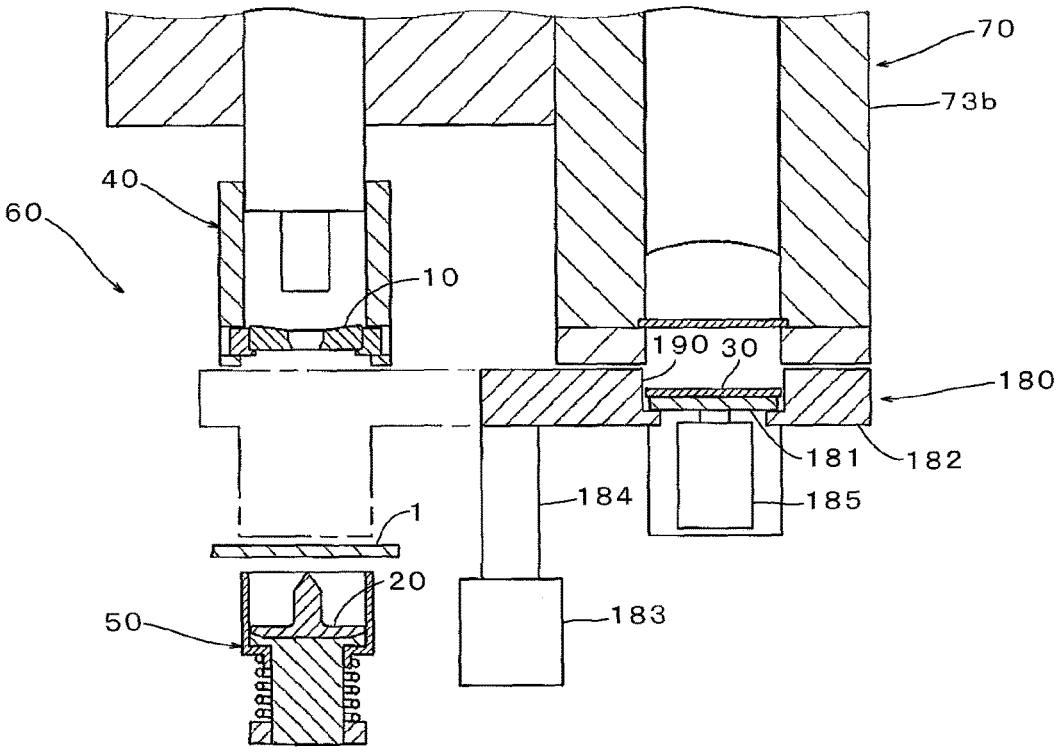
FIG. 19 is a cross-sectional explanatory view schematically illustrating another example of a first transport mechanism in the intermediate material transport unit in the button mounting apparatus.

FIG. 19 is a cross-sectional explanatory view schematically illustrating another example of the intermediate material transport unit 80 in the button mounting apparatus 100. Since the button mounting unit 60, the intermediate material formation unit 70 or the like are the same as in FIG. 6 etc., the same reference numerals are used and their explanations are omitted. The intermediate material transport unit 180 comprises a disk-shaped intermediate material receiving part 181, a support member 182, a motor 183 (see FIG. 5), and a vertical cylinder 185. The intermediate material receiving part 181 receives, on its upper surface, the intermediate material 30 from the intermediate material formation unit 70. The support member 182 receives and supports the intermediate material receiving part 181 in the opening 190. The motor 183 horizontally rotates the support member 182 about a shaft 184 connected to one end of the support member 182 between a first position at which the intermediate material receiving part 181 comes just below the housing 73*b* of the intermediate material formation unit 70 and a second position at which the intermediate material receiving part 181 comes just below the first die 40 of the button mounting unit 60. The vertical cylinder 185 delivers the intermediate material 30 to the intermediate material holder 44 of the first die 40 by lifting the intermediate material receiving part 181 located at the second position. The vertical cylinder 185 is disposed below the opening 190 of the support member 182. In this example, the support member 182, the motor 183 and the like for horizontally moving intermediate material 30 between the first and second positions constitute a first movement mechanism in the claims, and the vertical cylinder 185 or the like for lifting the intermediate material 30 at the second position constitutes a second movement mechanism in the claims.

Figure 20:
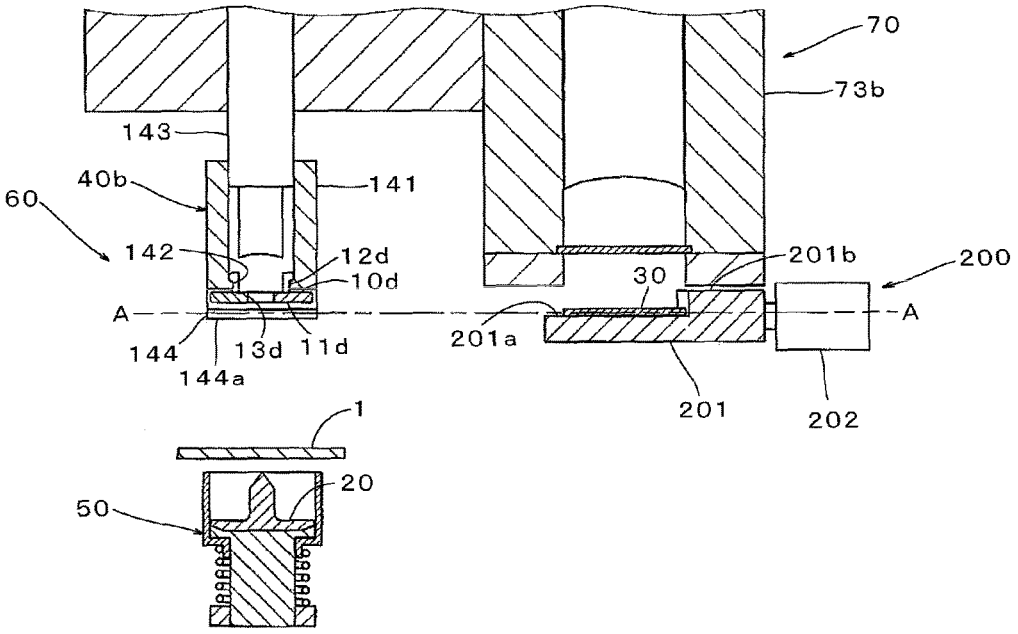
FIG. 20 is a cross-sectional explanatory view schematically illustrating an example of an intermediate material transport unit that does not need to lift the intermediate material at the second position.
Figure 21:
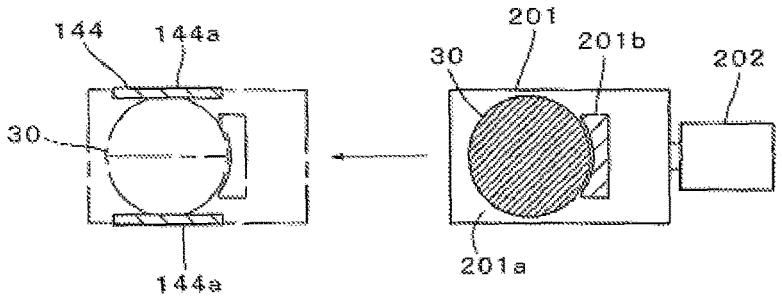
FIG. 21 is a cross-sectional view taken along a line A-A in FIG. 20.

In the above descriptions, as the intermediate material transport unit 80, 180, examples are cited in which the intermediate material 30 is transported from the first position to the second position and then is raised at the second position, but the invention is not limited thereto. FIG. 20 is a cross-sectional explanatory view schematically illustrating an example of an intermediate material transport unit 200 that does not need to lift the intermediate material 30 at the second position. Since the button mounting member 20, the second die 50, the intermediate material formation unit 70 and the like are the same as those in FIG. 6 etc., the same reference numerals are used and their explanations are omitted. FIG. 21 is a cross-sectional view taken along a line A-A of FIG. 20. The intermediate material transport unit 200 comprises a rectangular intermediate material receiving member (intermediate material receiving part) 201 and a horizontal cylinder 202. The intermediate material receiving member receives, on its upper surface 201*a*, the intermediate material 30 from the intermediate material formation unit 70. The horizontal cylinder 202 horizontally moves the intermediate material receiving member 201 between a first position at which the intermediate material receiving member 201 comes just below the housing 73*b* of the intermediate material formation unit 70 and a second position at which the intermediate material 30 on the intermediate material receiving member 201 is automatically delivered to the button holder 142 of the first die 40*b* (as described below) of the button mounting unit 60. On the upper surface 201*a* of the intermediate material receiving member 201A, there is provided a stopper 201*b*, which supports the right side of the periphery of the intermediate material 30 to prevent the intermediate material 30 from being displaced rightward. The first die 40*b* comprises a cylindrical body 141, a button holder 142 provided at the lower end of the cylindrical body 141, a punch unit 143, and an intermediate material holder 144 provided below the cylindrical body 141. The button main body 10*d* in FIG. 20 is a male snap made of resin or metal, and has a disk-shaped base 11*d*, a cylindrical engagement projection 12*d* projecting from the base 11*d*, and a mounting opening 13*d* formed at the center of the base 11*d*. The button holder 142 of the first die 40*b* is configured to receive the engagement projection 12*d* of the button main body 10*d* in the lower end portion of the hollow shaft portion of the cylindrical body 141 and elastically hold the engagement projection 12*d* therein. The intermediate material holder 144 of the first die 40*b* comprises a pair of front and rear holding plates 144*a* and 144*a* projecting downward from the lower end of the cylindrical body 141. A gap between the holding plates 144*a* and 144*a* is set to be slightly smaller than the diameter of the intermediate material 30. Thus, when the intermediate material 30 is transported to the intermediate material holder 144 of the first die 40*b* which is the second position by the intermediate material receiving member 201, the intermediate material 30 is elastically interposed between the holding plates 144*a* and 144*a* and held between them. At this time, the stopper 201*b* of the intermediate material receiving member 201 serves to push the intermediate material 30 between the left holding plates 144*a* and 144*a*. Subsequently, the mounting work of the button main body 10*d* to the cloth 1 is performed.

DESCRIPTION OF REFERENCE NUMBERS

1 cloth
10, 10*a*, 10*b*, 10*c*, and 10*d* button main body
20, 20*a*, 20*b* button mounting member
30 intermediate material
40, 40*a*, 40*b* first die
42, 142 button holder
43 punch
44, 144 intermediate material holder
50 second die
60 button mounting unit
70 intermediate material formation unit
71 sheet supply unit
72 drive roller
73 cutting unit
73*a* cutting blade
80, 180, 200 intermediate material transport unit
81, 181, 201 intermediate material receiving part
82, 182 support member
83 horizontal cylinder
84 operating rod
85, 185 vertical cylinder
90, 190 opening portion
91 intermediate material housing unit
92 receiving part support opening
100 button mounting apparatus

The invention claimed is:

1. A button mounting apparatus for mounting a button main body to a cloth with a button mounting member, the button mounting apparatus comprising:

a button mounting unit that includes a first die configured to hold the button main body and a second die configured to hold the button mounting member;

an intermediate material formation unit that forms an intermediate material from a strip-like sheet material, the intermediate material being interposed between the button main body and the cloth or between the button mounting member and the cloth; and an intermediate material transport unit that transports the intermediate material formed by the intermediate material formation unit to the button mounting unit to supply the intermediate material to the first die or the second die.

2. The button mounting apparatus according to claim 1, wherein the intermediate material transport unit holds the intermediate material transported to the button mounting unit on the first die or the second die.

3. The button mounting apparatus according to claim 1, wherein the intermediate material transport unit includes an intermediate material receiving part configured to receive the intermediate material formed by the intermediate material formation unit, and a first movement mechanism configured to move the intermediate material receiving part between a first position corresponding to the intermediate material formation unit and a second position corresponding to the button mounting unit.

4. The button mounting apparatus according to claim 3, wherein the intermediate material transport unit includes a second movement mechanism for moving the intermediate material receiving part, at the second position, between an initial position relatively distant from the first die or the second die and a delivery position adjacent to the first die or the second die so as to deliver the intermediate material to the first die or the second die.

5. The button mounting apparatus according to claim 1, wherein the intermediate material formation unit includes a sheet supply unit around which the sheet material is wound in a roll shape, a drive roller configured to send out the sheet material from the sheet supply unit by pulling the sheet material, and a cutting unit provided between the sheet supply unit and the drive roller to cut off the intermediate material from the sheet material.

6. The button mounting apparatus according to claim 1, wherein the first die has an intermediate material holder capable of holding the intermediate material that has an outer form greater than that of the button main body.

7. The button mounting apparatus according to claim 1, wherein the intermediate material formation unit includes a sheet passage through which the sheet material passes and a cutting unit in which the intermediate material is punched out from the sheet material that is passing through the sheet passage.

8. A button mounting method comprising the steps of:

A) holding a button main body on a first die and holding a button mounting member on a second die;

B) forming an intermediate material by cutting it out from a strip-like sheet material in an intermediate material formation unit;

C) automatically transporting and delivering the intermediate material from the intermediate material formation unit to the first die or the second die; and D) mounting the button main body onto a cloth with the button mounting member while interposing the intermediate material between the button main body and the cloth or between the button mounting member and the cloth.

9. The button mounting method according to claim 8, wherein the steps B and D are simultaneously performed.

10. The button mounting method according to claim 8, wherein in the step B the intermediate material is punched out from the sheet material that is passing through a sheet passage.

* * * * *